United States Patent [19]

Young, Jr.

[11] Patent Number: 4,468,997

[45] Date of Patent: Sep. 4, 1984

[54] FRETBOARD TO SYNTHESIZER INTERFACE APPARATUS

[75] Inventor: Leroy D. Young, Jr., Miami, Fla.

[73] Assignee: John Ellis Enterprises, Nashville, Tenn.

[21] Appl. No.: 464,386

[22] Filed: Feb. 7, 1983

[51] Int. Cl.[3] ..... G10H 1/00

[52] U.S. Cl. ..... 84/1.01; 84/1.16; 84/DIG. 30

[58] Field of Search ..... 84/1.01, 1.16, DIG. 30, 84/1.24, 1.03

[56] References Cited

U.S. PATENT DOCUMENTS

| | | | |
|---|---|---|---|
| 3,851,265 | 11/1974 | Young | 328/140 |
| 4,430,917 | 2/1984 | Pepper, Jr. | 84/1.01 |
| 4,430,918 | 2/1984 | Meno | 84/1.16 |

*Primary Examiner*—Forester W. Isen

*Attorney, Agent, or Firm*—Jackson, Jones & Price

[57] ABSTRACT

Apparatus for detecting note selection on a guitar fretboard including a differential amplifier for detecting voltage drops across successive fret pairs, a multiplexer for connecting successive fret pairs to the differential amplifier, counters for maintaining an indication of the string and fret position under examination, and a shorting string placed across the frets for insuring reliable circuit operation.

6 Claims, 1 Drawing Figure

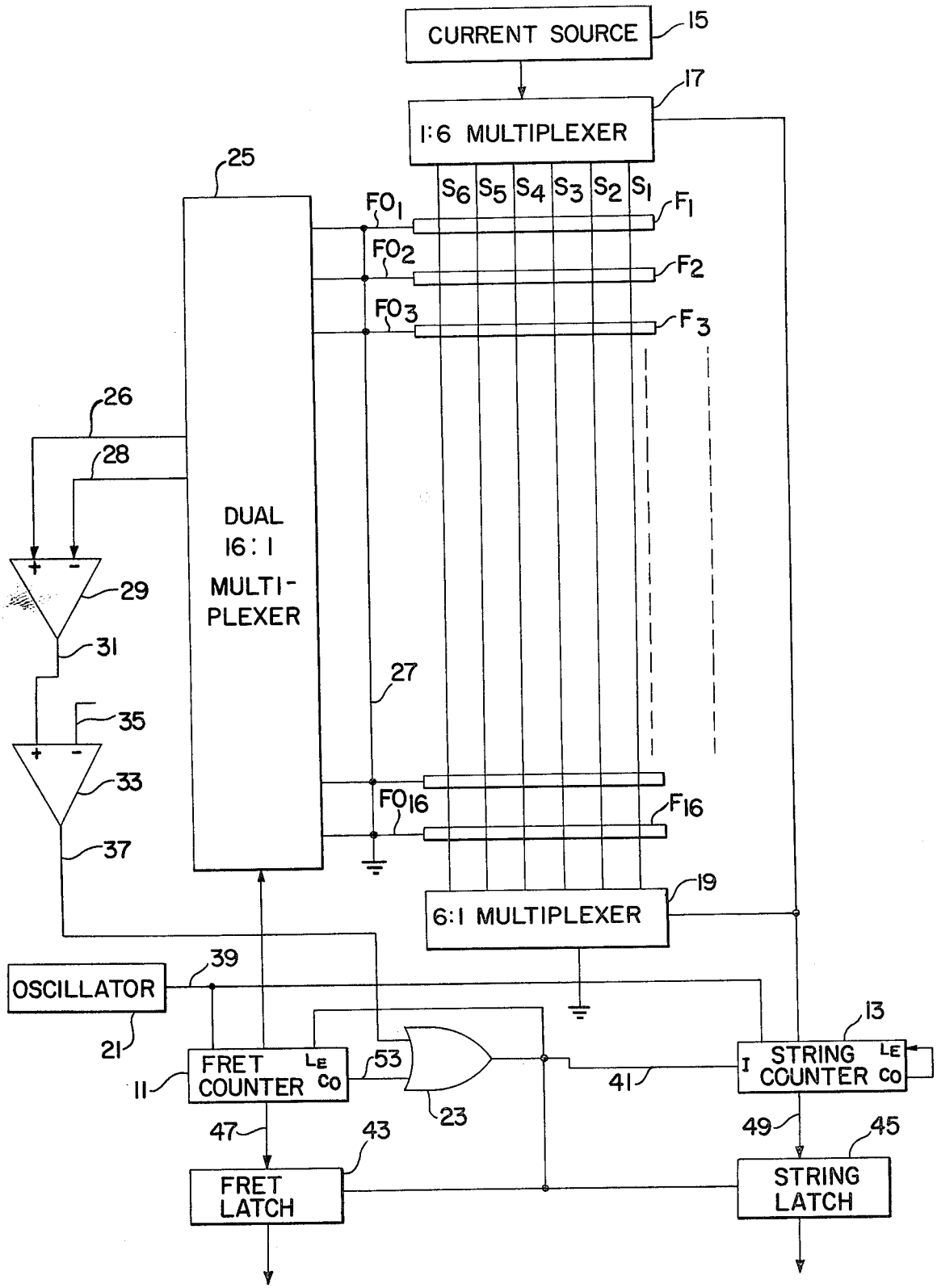
CURRENT SOURCE
15
17
1:6 MULTIPLEXER
25
S6 S5 S4 S3 S2 S1
FO1
F1
FO2
F2
FO3
F3
26
28
DUAL
16:1
MULTI-
PLEXER
29
31
27
35
33
FO16
F16
37
19
6:1 MULTIPLEXER
39
OSCILLATOR
21
13
FRET
COUNTER
LE
CO
53
11
23
41
STRING
COUNTER
I
LE
CO
47
43
49
45
FRET
LATCH
STRING
LATCH

FRETBOARD TO SYNTHESIZER INTERFACE APPARATUS

BACKGROUND OF THE INVENTION

Field of the Invention

The subject invention relates to a musical apparatus and more particularly to circuitry for detecting which note or notes have been selected by a musician on a guitar or other fret board. Such circuitry finds particular use in providing control signals to an electronic synthesizer.

Numerous attempts have been made to develop a universal guitar-to-synthesizer interface. Since synthesizers themselves are now quite advanced, much of this effort has been in the area of the guitar itself. The prime problem has been in accurately determining the notes that a guitarist is playing in order to direct the synthesizer to play the corresponding notes. Two general methods have produced somewhat fruitful results: positional sensing and time extraction. Positional sensing methods usually involve utilizing the metal strings and metal frets in a switching matrix to determine where a particular string is depressed against a fret. To facilitate polyphonic note determination (more than one note at a time), this method has required each of the metallic frets to be split into six insulated segments - one for each string at each fret (see U.S. Pat. No. 3,482,029). This is a costly, mechanically deficient method but variations of this method have seen some commercial usage.

The time extraction method is typically a period measurement technique where the actual vibrational output of the strings is filtered and processed to yield a voltage corresponding to the note being plucked. This method is susceptable to a variety of problems including string-to-string interactions noticeable delays in note determination, and various noise-induced phenomena. However, this has been the most commercially successful method since it allows normal user controlled musical nuances to be applied such as string bending, hammers, slides, etc. Reliability in tracking the individual notes has been the severest problem of this method and has probably done more to cause user resistance to guitar control of synthesizers than any other single reason.

A typical guitar comprises six metal strings stretched across a neck and a companion body. These strings may vary in diameter from 0.009 to 0.043 inches (from the highest frequency string to the bass string). Normally, these strings are electrically described as being pure conductors which implies that they have zero resistance. However, with proper instrumentation, it can be shown via measurements, that the resistance of such strings is not truly zero. In fact, engineering data books tabulate resistances of various types of metallic wires as standard reference data. Data from such sources indicates that the resistance of steel wire of the diameters used on a guitar would be only a few ten thousandths of an ohm over the full length of a typical string.

It has occurred to the inventor that it would be advantageous to somehow utilize this resistive property of the strings to allow determination of positional information pertaining to where the string is depressed against a metal fret. It might appear possible theoretically to measure the resistance of a string from the bridge to the point that it touches a particular fret. Knowing the resistance-per-inch of that string would then allow detection of the length between the bridge and the fret and thus the note depressed. However, a number of practical considerations make this method unusable. First of all, the resistance of the string is so small that the resistance of the fret-to-string contact becomes significant in comparision. Also, as the strings age and become dirty and stretched, the resistance varies in an unpredictable way. Also, since none of the strings are the same diameter, even changing strings can cause all the circuitry to require readjustment. As more than one string is depressed, the measurements on a particular string become even more unpredictable due to the paralleling of the strings and resulting dropping of effective resistance.

Thus, any method using string resistance to determine positional information should be independent of string size, string aging, number of strings depressed, topology of the fingering on the neck, etc. It is an object of the invention to provide an apparatus that satisfies all the above requirements by using a "go/no-go" method of resistance measurements. Another object of this invention is to allow accurate polyphonic reproduction of guitar notings utilizing the reliability of positional sensing without resorting to costly, unreliable modifications to the guitar, which are required by prior art positional sensing methods. It is a further object of this invention to allow the guitarist maximum artistic control of the frequency of his notings.

SUMMARY OF THE INVENTION

According to the invention, a small current is caused to flow through one guitar string at a time. As current is flowing through a particular string, a voltage detection means is placed across fret pairs in succession, starting preferably with the highest two frets and progressing towards the open note end. Upon finding a voltage greater than some predetermined value at the output of the voltage detection means, scanning is halted and the fret number and string number is stored prior to going to the next string and its scan. This procedure continues cyclically with updating occurring every few milliseconds.

Specific inventive features include the use of differential amplifier means as a voltage detector means and the use of a "shorting string" to insure reliable operation of the circuitry as described in more detail below.

BRIEF DESCRIPTION OF THE DRAWINGS

The preferred embodiment of the invention will now be described in detail in conjunction with FIG. 1 which is a schematic circuit diagram of the preferred embodiment of the invention.

DETAILED DESCRIPTION OF THE PREFERRED EMBODIMENT

The circuit of FIG. 1 fulfills the function of positional sensing for a guitar neck and gives as its output two binary numbers. One of the two numbers indicates which one of six strings was just scanned, and the second number gives the number of the first fret found with a string depressed against a fret during that scan time. These two numbers are provided at the outputs of respective counters 11, 13. Scanning proceeds from the highest note to the lowest note on each string. The structure of the circuitry for controlling the counter outputs will now be described after which its operation will be described in detail.

The preferred embodiment of the invention is shown in FIG. 1. The preferred embodiment interfaces with a plurality of guitar frets $F_1 \ldots F_{16}$ overlayed by a plurality of guitar strings $S_1 \ldots S_6$. In practice the frets $F_1 \ldots F_{16}$ and strings $S_1 \ldots S_6$ are those of a conventional guitar. Fret $F_1$ is closest to the bridge of the guitar such that the note defined by fret pair $F_1$ and $F_2$ on string $S_6$ is the note of highest frequency on the fretboard.

In addition, the strings $S_1 \ldots S_6$ are electrically isolated from one another at both ends of the guitar. The head end of the guitar is normally this way since the metal tuning pegs are independent items. However, with metal bridges and tailpieces, modifications must be done. This may be as simple as replacing the metal bridge saddle pieces with commercially available plastic units and inserting plastic sleeves in the tailpiece. Further, wires must be attached to each fret $F_1 \ldots F_{16}$ and to each string $S_1 \ldots S_6$ at both ends, for example, by using conductive epoxy.

As further shown in FIG. 1, a current source 15 is connected to a 1:6 multiplexer 17 having six outputs, each output connected to a respective one of the six strings $S_1$ to $S_6$. At the opposite end of the keyboard, a 6:1 multiplexer has each of its six inputs connected to a respective string and its output connected to ground. The multiplexers 17, 19 may be combinations of commercially available units such as the CD4051.

A control code is supplied to each multiplexer from the 4-bit string counter 13. This counter 13 counts binarily from 10 to 15. It may be an SN74163 counter having its carry-out output connected to its load-enable input. It receives inputs from an oscillator 21 and an OR gate 23, which control its count as described in greater detail hereafter. The count of the counter 13 forms the control code to the multiplexers 17, 19 and causes current to be supplied through a string, e.g. Sl to ground via the multiplexers 17, 19. Each successive count by the counter 13 causes current flow through a different one of the six strings $S_1$ to $S_6$.

Each of the sixteen frets $F_1$ to $F_{16}$ is provided with a conductive output $F0_1 \ldots F0_{16}$ to a dual 16:1 multiplexer 25. A suitable commercially available multiplexer 25 is the CD4051. The frets $F_1$–$F_{16}$ are further shorted to ground by a conductor 27 connected in common with each conductor $F0_1 \ldots F0_{16}$. The dual multiplexer 25 has two outputs 26, 28 (e.g. pin nos. 3, 3).

The two outputs 26, 28 of the dual multiplexer 25 are connected to the input of a differential amplifier 29. The output 31 of the differential amplifier 29 supplies the noninverting input of a comparator 33. The other input to the comparator 33 is a suitable reference voltage 35. A differential amplifier is useful for giving high amplification for signals remotely located since common-mode noise signals are effectively canceled by the differencing action of the amplifier.

The comparator output 37 is connected via the OR gate 23 to increment the string counter 13 when the comparator 33 detects a voltage at its non-inverting input in excess of the reference level. The differential amplifier 29 may comprise two LN4558 units arranged for common mode rejection. Comparator 31 may be a commercially available unit such as an LN311 unit.

A second input to the OR gate 23 is provided by the carry-out of a fret counter 11. The fret counter 11 counts (binarily) from 0 to 15 in response to pulses from the oscillator 21 on a line 39. The fret counter 11 receives a load enable signal on a line 41 from the output of the OR gate 23. The fret counter 11 also supplies its 4-bit count to the dual multiplexer 25.

A fret latch 43 and a string latch 45 are provided to latch counts indicative of the string and fret upon which a note has been played. The fret latch 43 receives a 4-bit output on four lines 47 from the fret counter 11. The string latch 45 receives a 3-bit output on line 49 from the string counter. These latches 43, 45 are activated to latch the count of the respective string and fret counters 13, 11 by occurrence of an output on line 41 from the OR gate 23.

Finally, a "shorting string 27" is connected to each fret output $F0_1 \ldots F0_{16}$ and to ground. This string may be a 0.009 inch string such as the first string $S_1$. The shorting string $S_1$ actually provides a small finite resistance between each fret pair such as $F_1$–$F_2$. The length of the shorting string between each fret pair is approximately the distance between the frets.

The operation of the just described circuit of the preferred embodiment will now be described in more detail.

In FIG. 1, the oscillator 23 provides timing pulses for the rest of the circuit. The frequency of this oscillator may be, for example, in the range of 15–20 kHz, allowing full scan of the fret board in a time on the order of 5 or 6 milliseconds (ms) or less. The oscillator 23 is used to increment the fret counter 11 which in turn is used to increment the string counter 13.

To illustrate the operation, assume both of these counters 11, 13 are initialized (all zeros at their outputs). This first state causes the string counter 13 to present a binary code to the 1:6 multiplexer 17 forcing it to provide a path from the current source 15 to the first string $S_1$. The 6:1 multiplexer 19 receives the same string code as the 1:6 multiplexer 17 and is forced to provide a path to ground for the current applied to the first string $S_1$. The current may be on the order of 100 milliamps.

In the first (all zero) state, the fret counter 11 presents a code to the dual 16:1 multiplexer 25 forcing it to provide a connection from the first fret $F_1$ to one input 26 of the differential amplifier 29 and from the second fret $F_2$ to the other input 28 of the differential amplifier 29. If the first string $S_1$ is depressed against the fret pair $F_1$ and $F_2$, a voltage will be produced at the output of the differential amplifier 29 which will exceed the threshold of the comparator 33. A suitable differential amplifier may have a gain on the order of 1,000, providing output signals on the order of a few volts, with the comparator reference level set to about two-tenths of a volt (0.2V). When presented with a voltage that exceeds its threshold, the comparator 33 produces a pulse which enables loading of the count of the string counter 13 and the count of the fret counter 11 into the string latch 43 and fret latch 45, respectively, at the next clock edge on line. This pulse will also reinitialize the fret counter 11 to all zeroes and increment the string counter 13 to its next state.

If string $S_2$ was not depressed on frets $F_1$ and $F_2$ during the first state of counter 13, the next clock will instead increment the fret counter 11 causing it to present a code to the dual 16:2 multiplexer 25, forcing it to provide a path from fret $F_2$ to one input 26 of the differential amplifier 29 and from Fret $F_3$ to the other input 28 of the differential amplifier 29. Such scanning continues on the first string $S_1$ until a fret pair is found depressed or until all frets $F_1$ to $F_{16}$ have been scanned. If no frets are found depressed, the fret counter 11 will produce a "carry-out" pulse on line 53 which will load a number signifying "open note" into the fret latch 43. This "carry-out" pulse will also increment the string counter to the count representing the second string $S_2$. This type of action continues through the sixth string $S_6$ at which time the string counter 13 will "roll over" to the first string $S_1$ and begin anew.

The "shorting" string 27 serves two purposes—first, in the absence of any input to the high gain differential amplifier 29, small perturbations on either input (such as a finger touching one of the frets) can cause false outputs. Having a section of the shorting string 27 placed across the inputs of the differential amplifier 29 independent of any fret pair depressions, effectively "quiets" the output of the differential amplifier for all scan positions. If a string $S_1$ to $S_6$ is depressed, circuit behavior reverts to the previouslydescribed operation with only a paralleling effect.

Second, the shorting string 27 serves as an alternate current path for certain special circumstances. On some guitars there is no guarantee that the "fret pair" consideration will be satisfied for all strings, all over the neck. That is, only one fret may be touching the string in some locations. However, shorting string 27, allows current to flow to ground through it and thus give the required differential input to the amplifier 29.

In practice, it proves useful to provide auto-zeroing of the comparator 33. This is because the output of differential amplifier 29 may vary slightly from the ideal value during operation. Auto-zeroing compensation is known to those skilled in the art. Essentially, the technique is to sample the differential amplifier output voltage just prior to its being supplied with a fret pair input by the multiplexer and by adding the sampled voltage to the reference voltage presented to the comparator 33.

Many modifications of the preferred embodiment may be made without departing from the scope of the invention. For example, a differential amplifier might be placed on each fret pair, each differential amplifier being followed by a comparator. The comparator outputs would then be multiplexed. The shorting string would still connect the differential amplifier inputs to ground. Another variation would be to use alternating currents of six different frequencies, one frequency being passed through each string. By using tuned differential amplifiers, all six strings could be simultaneously monitored.

Numerous other modifications and adaptations will be apparent to those skilled in the art without departing from the scope and spirit of the invention. Therefore, it is to be understood that, within the scope of the appended claims, the invention may be practiced other than as specifically described herein.

What is claimed is:

1. Fretboard to synthesizer interface apparatus including a fretboard having a plurality of frets and a plurality of strings stretched thereover comprising:

means for causing a current to flow through each of a succession of said strings;

means for detecting a differential voltage across each of a succession of adjacent fret pairs of said guitar, which voltage is indicative of a depression of a said string at the fret position bracketed by said fret pair, and for generating a control signal upon said detection; and means for maintaining a count indicative of the fret pair under examination by said detecting means and for latching said count in response to said control signal.

2. The apparatus of claim 1 wherein said means for detecting a voltage includes a conductor connecting each of said frets to ground.

3. Guitar to synthesizer apparatus comprising:

means for causing a current to flow through a succession of guitar strings;

differential amplifier means;

means for conductively connecting a succession of adjacent pairs of frets of said guitar to said differential amplifier means;

counter means for maintaining a count indicative of the string subjected to a current by said means for causing current flow and indicative of the fret pair connected to said differential amplifier means;

comparator means for comparing the output of said differential amplifier to a reference level and providing a control signal to latch the count of said counter means upon detection of a differential output in excess of said reference level.

4. The apparatus of claim 2 further including shorting string means connecting each fret to ground.

5. Apparatus for detecting a note selected on a guitar including a fret-board and strings comprising:

a current source;

differential amplifier means;

counter means for providing a count corresponding to a particular guitar string and to a particular fret position;

means responsive to the count of said counter means for gating a current from said current source successively through each string of said guitar and for gating successive voltage drops indicative of the voltage drop across successive pairs of frets of a said string to said differential amplifier means; and means responsive to the output of said differential amplifier means for detecting a voltage indicative of a selection of the note between a particular fret pair and for latching the count of said counter means indicative of the string and fret position selected.

6. Circuitry for detecting selection of a note on a fretboard having a plurality of adjacent frets and a plurality of conductive strings stretched thereover, said circuitry comprising:

a shorting string means providing a small but finite resistance between each said fret and grounded at one end; and differential amplifier means for receiving inputs from a plurality of pairs of said frets and providing an output indicative of depression of a said conductive string across a pair of said frets.

* * * * *